US005201525A

United States Patent [19]

Castro

[11] Patent Number: 5,201,525

[45] Date of Patent: Apr. 13, 1993

[54] CARD GAME UTILIZING BASEBALL TRADING CARDS

[76] Inventor: Wendell R. Castro, P.O. Box 10971, Hilo, Hi. 96721

[21] Appl. No.: 867,381

[22] Filed: Apr. 13, 1992

[51] Int. Cl.[5] ..... A63F 1/00

[52] U.S. Cl. ..... 273/293; 273/298; 273/303; 273/93 C; 40/159; 40/156; 40/124.2

[58] Field of Search ..... 273/298, 303, 292, 93 R, 273/93 C, 244, 240, 287, 293; 40/159, 156, 124.1, 124.2; 229/70–75

[56] References Cited

U.S. PATENT DOCUMENTS

| | | | |
|---|---|---|---|
| 378,497 | 2/1888 | Couch | 273/298 |
| 1,709,634 | 4/1929 | Seybold | 273/298 |
| 3,130,973 | 4/1964 | Zapolski | 273/287 |
| 3,602,513 | 8/1971 | Breen | 273/240 |
| 4,333,254 | 6/1982 | Stevenson | 40/159 |
| 4,653,755 | 3/1987 | Panella et al. | 273/23 R |
| 4,944,968 | 7/1990 | Wagner | 40/159 |
| 5,071,136 | 12/1991 | Lott | 273/298 |

*Primary Examiner*—Benjamin H. Layno
*Attorney, Agent, or Firm*—Michael I. Kroll

[57] ABSTRACT

An improved card game is provided which consists of a plurality of trading cards or the like. A mechanism is provided for converting the trading cards into at least two sets of playing cards, so that the playing cards can be utilized in the improved card game. Another mechanism is provided for producing a random output count to determine the order of play for each player. A set of rules is used for playing the improved card game, whereby the object of the game is for a player to win the most trading cards from each of the opponent players.

9 Claims, 1 Drawing Sheet

CARD GAME UTILIZING BASEBALL TRADING CARDS

BACKGROUND OF THE INVENTION

1. Field of the Invention

The instant invention relates generally to games of chance and more specifically it relates to an improved card game.

2. Description of the Prior Art

Numerous games of chance have been provided in prior art that ar adapted to utilize a deck of playing cards in which the players obtain a certain combination of the cards in order to triumph over their opponents. While these units may be suitable for the particular purpose to which they address, they would not be as suitable for the purposes of the present invention as heretofore described.

SUMMARY OF THE INVENTION

A primary object of the present invention is to provide an improved card game that will overcome the shortcomings of the prior art devices.

Another object is to provide an improved card game in which protective cover holders will convert trading cards and the like inserted therein into playing cards, so that they can be used in the improved card game.

An additional object is to provide an improved card game in which each player can determine the value of each of their trading cards and the like by inserting them into the various protective cover holders having different types of corner indexes and suit markers thereon.

A further object is to provide an improved card game that is simple and easy to use.

A still further object is to provide an improved card game that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
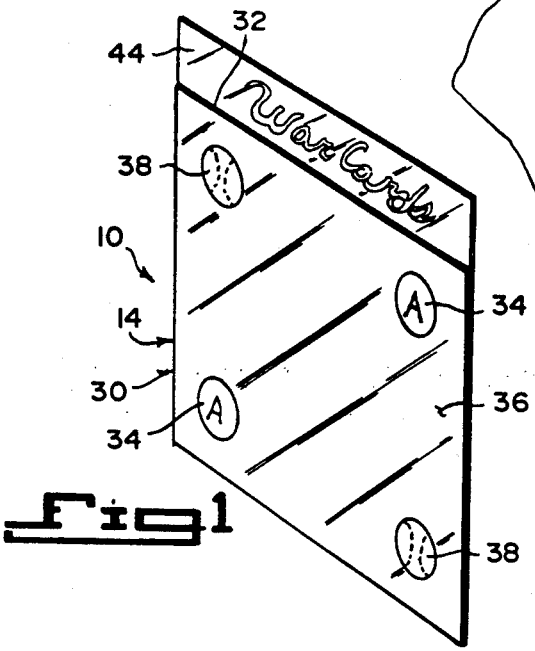
FIG. 1 is a front perspective view of a protective cover holder used in the improved card game with its particular logo and value.
Figure 2:
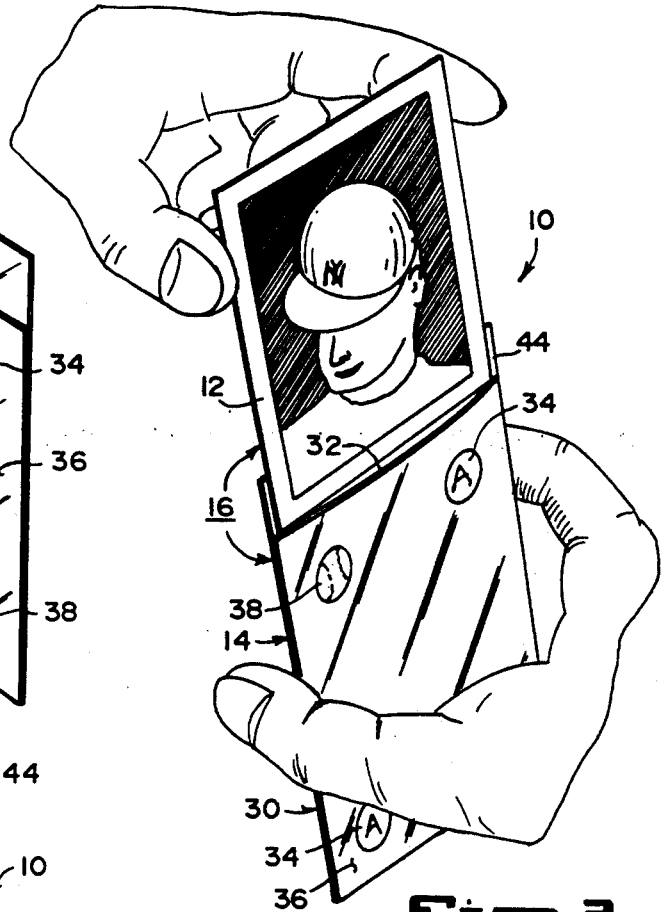
FIG. 2 is a trading front perspective view showing a card being inserted into the protective cover holder.
Figure 3:
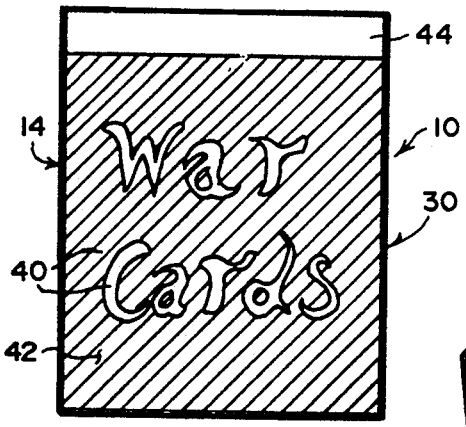
FIG. 3 is a rear view of the protective cover holder.

Turning now descriptively to the drawings, in which similar reference characters denote similar elements throughout the several views, the Figures illustrate an improved card game 10, which consists of a plurality of trading cards 12 or the like. A mechanism 14 is for converting the trading cards 12 or the like into at least two sets of playing cards 16, so that the playing cards 16 can be utilized in the improved card game 10. Another mechanism 18 is for producing a random output count to determine the order of play for each player. A set of rules 20 is used for playing the improved card game 10, whereby the object of the game 10 is for a player to win the most trading cards from each of the opponent players.

The improved card game 10 further includes a container 22 for storing the trading cards 12 or the like, the converting mechanism 14, the random output count producing mechanism 18 and the set of rules 20 therein when not being used. The container 22 is a rectangular shaped box 24 having a plurality of compartments 26 therein, for storing the various articles when not being used. The container 22 further includes a rectangular shaped lid 28 for covering the rectangular shaped box 24 to protect the various articles within the compartments 26 when not being used.

The converting mechanism 14 includes a plurality of clear plastic protective cover holders 30, with each having a pocket 32 to receive one of the trading cards 12 or the like. A first indicia 34 is disposed on the front face 36 of each protective cover holder to indicate the value of the playing card 16. A second indicia 38 is disposed on the front face 36 of each protective cover holder 30 to indicate the suit of they playing card 16.

Each protective cover holder 10 also includes a third indicia 40 disposed across the complete back face 42, so that the back of the trading card 12 or the like will not be visible therethrough. Each protective cover holder 30 further includes an extension strip 44 extending therefrom, so that the name of the player may be written on the top extension strip 44 for identification.

The random output count producing mechanism 18 includes a plurality of individual gaming pieces 46, wherein each gaming piece 46 is a die 48. The gaming pieces 46 are a pair of dice 48, used to produce the random output count to determine the order of play among the players.

The first indicia 34 disposed on the front face 36 of thirteen of the protective cover holders 30 in one set of playing cards 16 includes the letters A, K, Q, J and numbers 10, 9, 8, 7, 6, 5, 4, 3 and 2 on each, in diagonal corners.

Figure 4:
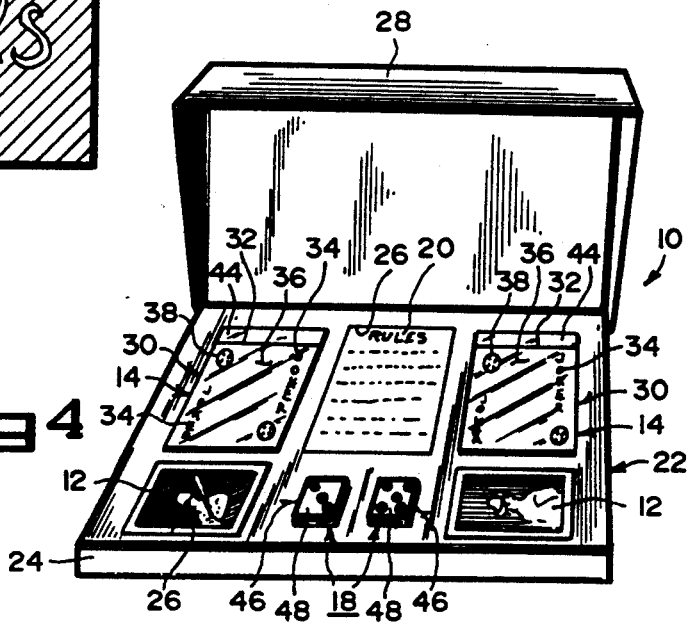
FIG. 4 is a perspective view of a box with its cover opened showing the various components therein used in playing the improved card game.

The first indicia 34 disposed on the front face of two of the protective card holders 30 in one set of playing cards 16 further includes the word joker on each, in diagonal corners as shown in FIG. 4 and therefore making up 15 cards per set.

The second indicia 38 disposed on the front face 36 of all fifteen of the protective card holders 30 in one set of playing cards 16, includes a logo being of the same shape to indicate the same suit, in opposite diagonal corners.

Rules Of The Game

1. Two players are needed as a minimum to play the game 10.

2. Each player picks a set of fifteen protective cover holders 30 having the same suit thereon.

3. Each player then inserts each of their fifteen trading cards 12 or the like into each of the protective cover holders 30 to make the playing cards 16.

4. Each player's 15 playing cards 16 are separately shuffled then placed face down on a flat surface in front of the respective player.

5. The dice 48 are then tossed to determine the order of play.

6. The top playing card 16 of the first player's set is turned over.

7. The top playing card 16 of the second player is turned over, if. If his card 16 matches the card 16 of the first player than the second player wins and takes the opponent's card.

8. The winner removes the trading card 12 or the like and returns the protective cover holder 30 at the end of the game.

9. The winner of each round will start the play of playing cards 16 in the next round.

10. The object of the game is for a player to win the most trading cards 12 or the like from each of the opponent players.

LIST OF REFERENCE NUMBERS

10 improved card game
12 trading card or the like
14 converting mechanism
16 playing card
18 random output count producing mechanism
20 set of rules
22 container
24 rectangular shaped box for 22
26 compartment in 24
28 rectangular shaped lid
30 clear plastic protective cover holder
32 pocket in 30
34 first indicia for value
36 front face of 30
38 second indicia for suit
40 third indicia
42 back face of 30
44 top extension strip
46 gaming piece for 18
48 die It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation ca be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved card game which comprises:

a) a plurality of trading cards;

b) means for converting said trading cards into at least two suits of playing cards, so that said playing cards can be utilized in said improved card game, said converting means includes a plurality of clear plastic protective cover holders, with each having a pocket to receive one of said trading cards, a first indicia representing one of a plurality of different playing card values disposed on the front face of each said protective cover holders to provide a playing card value to each of said trading cards received in said pockets, a second indicia representing one of at least two different playing card suits disposed on the front face of each said protective cover holders to provided a playing card suit to each of said trading cards received in said pockets, wherein the protective cover holders of a common suit each having a different playing card value of said plurality of different playing card values;

c) means for producing a random output count to determine the order of play for each player;

d) a set of rules for playing said improved card game, whereby the object of the game is for a player to win the most trading cards from each of the opponent players; and e) a container for storing said trading cards said converting means, said random output count producing means and said set of rules therein when not being used, said container is a rectangular shaped box having a plurality of compartments therein for storing the various articles when not being used, said container further includes a rectangular shaped lid for covering said rectangular shaped box to protect the various articles within the compartments when not being used.

2. An improved card game as recited in claim 1, wherein each said protective cover holder includes a third indicia disposed across the complete back face, so that the back of said trading card or the like will not be visible therethrough.

3. An improved card game as recited in claim 2, wherein each said protective cover holder further includes a top extension strip extending therefrom, so that the name of the player may be written on said top extension strip for identification.

4. An improved card game as recited in claim 3, wherein said random output count producing means includes a plurality of individual gaming pieces.

5. An improved card game as recited in claim 4, wherein each said gaming piece is a die.

6. An improved card game as recited in claim 5, wherein said gaming pieces are a pair of dice, used to produce the random output count to determine the order of play for each player.

7. An improved card game as recited in claim 6, wherein said first indicia disposed on the front face of thirteen said protective cover holders in one set of playing cards includes the letters A, K, Q, J, and numbers 10, 9, 8, 7, 6, 5, 4, 3 and 2 on each.

8. An improved card game as recited in claim 7, wherein said first indicia disposed on the front face of two said protective card holders in one set of playing cards further includes the word joker on each.

9. An improved card game as recited in claim 8, wherein said second indicia disposed on the front face of all fifteen said protective card holders in one set of playing cards includes a logo being of the same shape to indicate the same suit.

* * * * *